United States Patent [19]

Illum

[11] 4,217,021

[45] Aug. 12, 1980

[54] SCREWLESS WIRE TERMINAL AND SPRING CLIP THEREFOR

[75] Inventor: Asger Illum, Solroed Strand, Denmark

[73] Assignee: Aktieselskabet Laur. Knudsen, Nordisk Elektricitets Selskab, Copenhagen, Denmark

[21] Appl. No.: 971,906

[22] Filed: Dec. 21, 1978

[51] Int. Cl.[2] ..... H01R 9/06

[52] U.S. Cl. ..... 339/95 D; 339/61 R; 339/248 S; 339/256 R; 339/260; 24/81 B

[58] Field of Search ..... 339/95 D, 61 R, 248 S, 339/256 R, 260; 24/81 B, 115 G

[56] References Cited

U.S. PATENT DOCUMENTS

| | | | |
|---|---|---|---|
| 2,968,780 | 1/1961 | Roswell | 339/95 D X |
| 3,596,229 | 7/1971 | Hohorst | 339/95 D X |
| 3,945,711 | 3/1976 | Hohorst et al. | 339/95 D |
| 4,087,149 | 5/1978 | Fischer | 339/95 D |

*Primary Examiner*—Roy Lake
*Assistant Examiner*—D. W. Jones
*Attorney, Agent, or Firm*—Le Blanc, Nolan, Shur & Nies

[57] ABSTRACT

A screwless wire terminal for electric conductors, consisting of a plate-shaped contact against which the conductors are pressed by means of a leaf spring of particular shape. The leaf spring has a U- and a T-shaped part, the stem of the latter starting at the inside of the U-shaped part. The two differently shaped spring parts lie at each side of the plate-shaped contact which has an aperture, the stem of the T-shaped part passing therethrough. Sharp spring edges at the T cross-piece engage the conductors thereby preventing conductor pull-out.

4 Claims, 5 Drawing Figures

SCREWLESS WIRE TERMINAL AND SPRING CLIP THEREFOR

Figure 1:
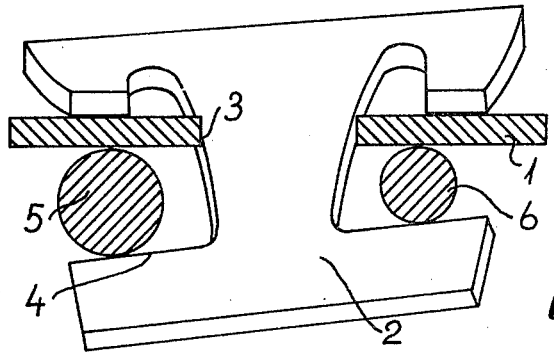

The present invention relates to a screwless connector for electrical leads consisting of a spring clip in an insulating housing, which spring clip engages a flat contact strip and a leaf spring with a sharp edge to engage at least one conductor in contact with the contact strip.

Several such screwless connectors are known, e.g., as described in U.S. Pat. Nos. 3,945,711 and 3,596,229. However, most of these require several steps in their manufacture such as providing special bends to the spring or special provisions for fixing the spring relative to the contact strip, which latter has been performed through riveting or folding of the pliable part over the other, non-pliable.

It is an object of the present invention to provide a screwless wire terminal of the kind described above which is particularly simple to manufacture and assemble—especially in an automated production line—and which is well suited for retaining one or two conductors of the same or different cross sections.

This is obtained by letting the spring clip be in one piece and constituted of a U-shaped and a T-shaped part with the stem of the T joining the U in the arch of the latter, the U-shaped part and the T-shaped part being disposed on either side of a contact strip, the stem of the T passing through an opening in the contact strip, the sharp gripping edge being on the side of the stroke of the T closest to the contact strip, abutments for the spring clip being provided in the housing.

A screwless wire connector made in the above mentioned manner has a number of advantages. A U-T-spring may be stamped from strip metal in one operation and does not need any bends whereby annealing for the removing of stresses is avoided. Accordingly the spring is at rest in its unstressed condition. In assembly the spring clip is simply pushed unto the contact strip which has a slit for the stem of the T. The spring clip stays in place without any need for fixing as the sharp edge of the stroke of the T rests against one side of the contact strip and the ends of the stems of the U rest against the other side. In this way, because of the thickness of the contact strip, the stroke of the T is at rest at an angle to the contact strip so that a wire pushed into this angular space will force the stroke of the T away from the contact strip against the spring force. When the contact strip with spring clip is mounted in the housing the abutments mentioned above prevent a longitudinal (in the direction of the inserted wire) displacement of the spring clip.

As the spring clip is in no way fixed to the contact strip it may tilt freely in relation to it and in particular if the two half-sections of the stroke of the T are unequally stressed the stem of the T may be subjected to torsion. Through a combination of bending and torsion a secure clamping of a single wire may be obtained or similarly two wires of the same or different cross sections, because the torsion in the T-part equalizes any unequal stresses. The combination of U-shape and T-shape provides a relatively long spring taking up only a small space since the spring length (giving the elasticity) may be regarded as the distance from the stroke of the T along the stem and to one end of the stem of the U. In this way the material of the spring is not unduly stressed.

The screwless terminal according to the invention has the important property that it does not transmit stresses to other parts, in particular to insulating material in the housing so that its function is in no way dependent upon or disturbed by deformation of the surrounding materials. As the sharp gripping edge on the spring clip is close to the outer end of the terminal there is ample space for bared wire inside the terminal, a feature not found in connectors having the gripping edge further in.

In an embodiment of the invention the ends of the stroke of the T are approximately across from the ends of the stems of the U when the spring is mounted on the contact strip. This makes for a very compact constuction and a minimum of spring material waste since the stamping may make just a cut between the stroke of the T and the stems of the U.

In order to obtain an even distribution of stress in the spring the widths of the stems of the U and the stem of the T may increase in the direction towards the arch of the U.

In order to unclamp wires the screwless terminal may be provided with a push-button which acts on the T-part of the spring.

Figure 2:
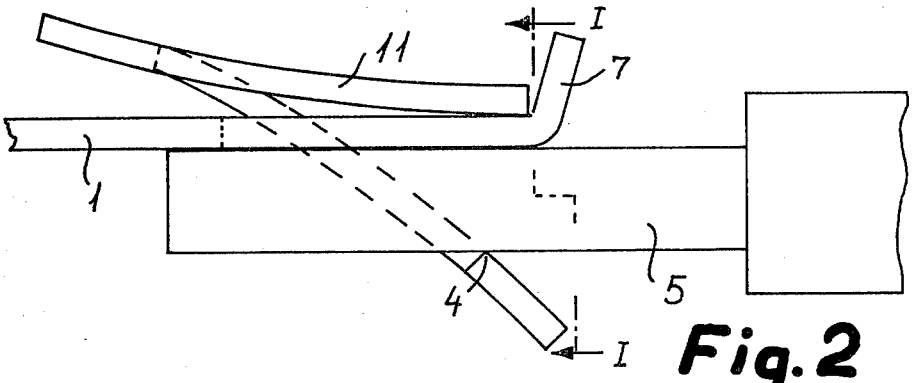
Figure 3:
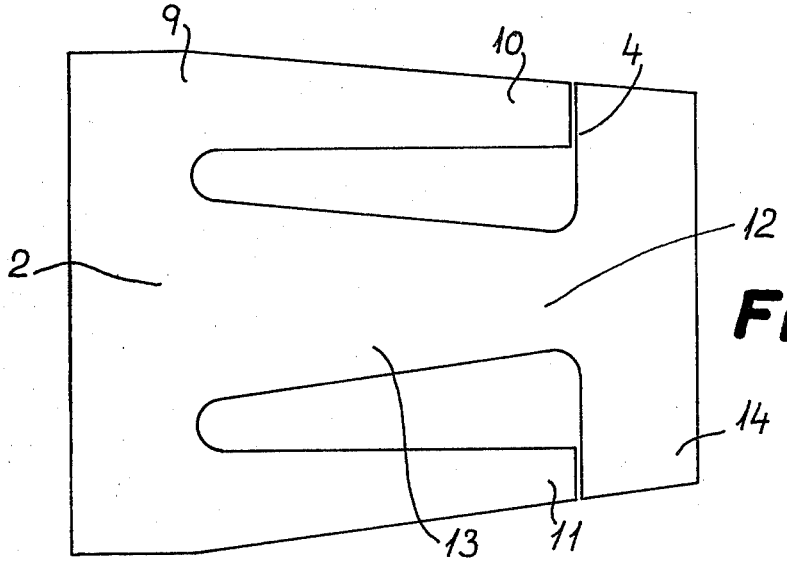
Figure 4:
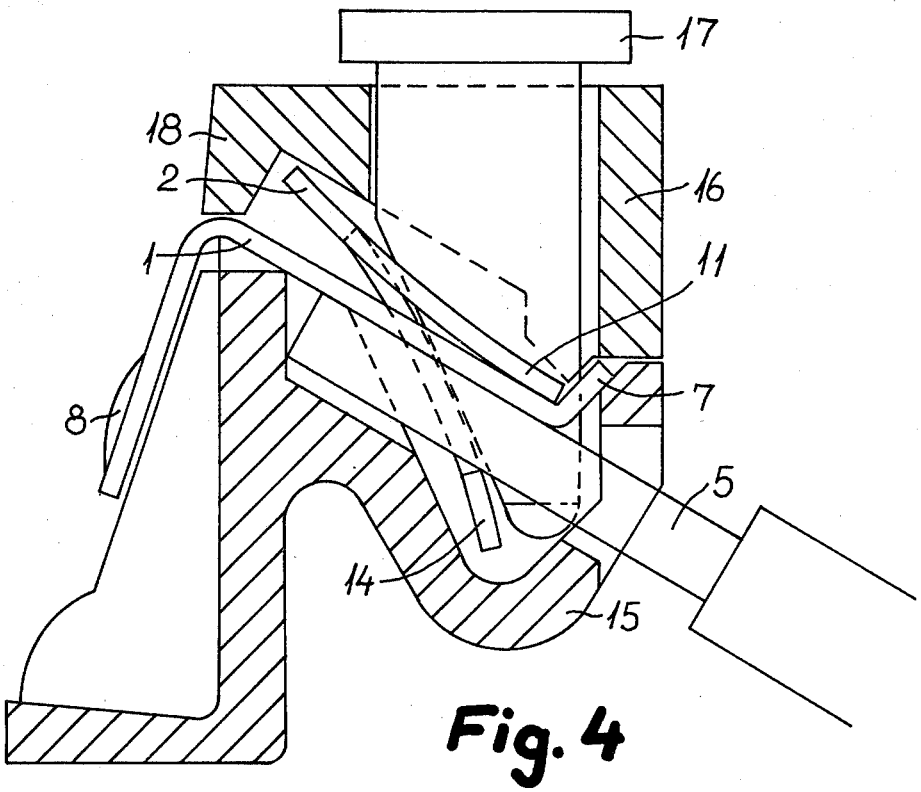
Figure 5:
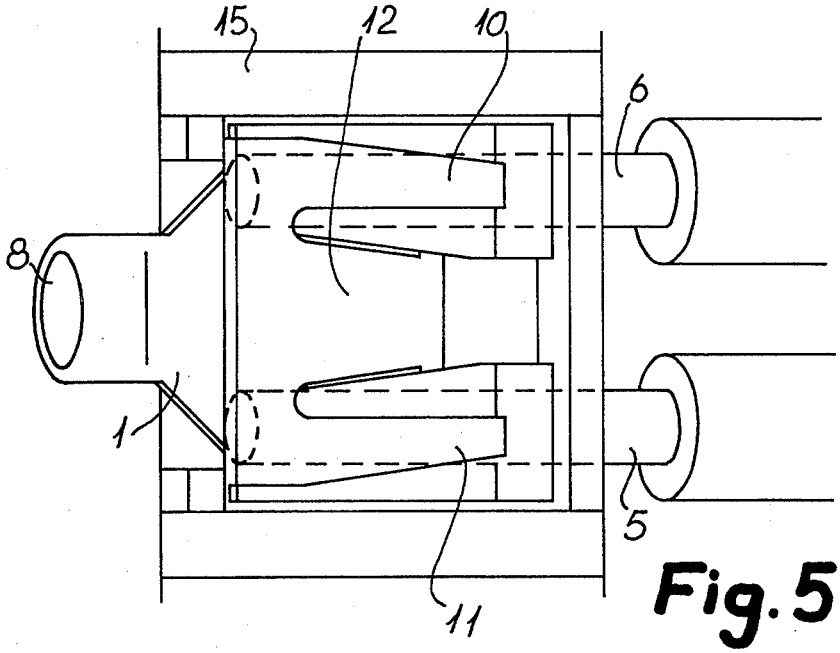

The invention is to be more fully described in the following with reference to the drawing in which:

FIG. 1 shows a cross section of a spring clip according to the invention with inserted wires along the the line I—I in FIG. 2, and FIG. 2 shows a longitudinal section of a spring clip according to the invention with a wire inserted, and FIG. 3 shows a spring for use in a spring clip according to the invention seen from above, and FIG. 4 shows a section through a terminal connector with housing and spring clip and push-button for unclamping the inserted wire, and FIG. 5 shows the same as FIG. 4 seen from above.

The reference numeral 1 on the drawing denotes a contact strip which may be made of brass and a leaf spring 2 may be made of stainless steel. The contact strip 1 has a section 3 cut into it which extends inwards from the upturned edges 7 of the contact strip 1 serve the double purpose of preventing the spring clip 2 from slipping from the contact strip 1 and of fixing the contact strip 1 in the housing 15, 16, 18 as seen on FIG. 4. A contact point 8 which may be of a noble metal is also shown in FIG. 4; this is to indicate the use of the screwless terminal in conjunction with a switch of which the contact point 8 forms one fixed contact.

As is most clearly seen from FIG. 3 the spring 2 is composed of a U-shaped part with stems 10 and 11 and a T-shaped pert 12 with a stem 13 which is joined to the arch of the U and a stroke 14 which on its underside has a sharp edge 4. The spring shaped thus may be stamped in one operation from a strip with a minimum of waste. The spring 2 is easily mounted on the contact strip 1 by being pushed sideways onto it so that the stem 13 passes through the section 3 and that the U-part and the T-part are at either side of the contact strip 1, the U-part resting against it with the ends of its stems 10 and 11 while the T-part rests against the contact strip 1 with the edge 4 of the stroke 14. The stroke 14 will stand at an angle to the contact strip 1 into which angular space bared wire ends 5 and 6 may be easily introduced, the stroke 14 being the moveable part. When the wire ends have passed the edge 4 this catches the surface of the conductor effectively thereby preventing unintentional withdrawal of the conductor while the spring force presses this against the contact strip 1.

As the spring 2 is simply pushed onto the contact strip 1 without apecial fixing provisions it may pivot freely relative to it so that it may handle wires 5,6 with different cross sections as well as a single wire. The torsion of the stem 12 of the T thus caused ensures an equalisation of the force so that a secure retention of the wire or wires is obtained in all instances.

As shown in FIGS. 4 and 5 the housing of the screwless terminal consists of a lower part 15 and an upper part 16, which latter carries and guides a release push-button 14 which acts on the stroke 12 of the T when it is pushed and which releases the wire ends 5 and 6. The upper part 16 has a flange 18 which serves as an abutment for the arch of the U-part 9 of the spring 2 and which prevents longitudinal displacement of the spring on the contact strip 1 during introduction of the wire ends 5 and 6. The turned-up ends of the contact strip 1 prevents displacement in the opposite direction, i.e. when exerting a pull in the wires. As is seen on the drawing, in particular on FIG. 4, the conductors need only be pushed a short way into the screwless terminal for it to hold them securely with the sharp edge 4. Therefore a good electrical contact with the contact strip is ensured. It will be seen that the spring force under no circumstances is transmitted to the housing 15, 16.

It should be noted that the screwless terminal, although described above for use with solid conductors may equally well be used with stranded conductors which will not support the force necessary to force apart the stroke 14 of the T and the contact strip 1. In this case the push-button 17 is acted upon at the same time as the stranded conductor is inserted and upon its release the screwless terminal eill hold it securely even though the strands may move with respect to each other and present a lower profile to the spring clip 2.

The screwless terminal according to the invention consists of very few parts which may be manufactured and assembled by automatic means and in spite of its small dimensions it provides sufficient force to be used in domestic switches with wire diameters up to 2 millimeter and spring forces greater than 15 Newton. That is, the holding action is not dependent upon the sharp gripping edge 4.

I claim:

1. A screwless wire terminal for electric wires having a contact strip and a sharp-edged leaf spring clip in a common housing to engage at least one wire which is in contact with the contact strip, wherein the spring clip is in one piece and consists of a U-shaped part and a T-shaped part, the stem of the T-part adjoining the inside arch of the U-part, the U-part and the T-part being disposed on either side of the contact strip by letting the stem of the T-part pass through a section in the contact strip, the sharp edge being provided at the underside of the stroke of the T-part, the housing being provided with abutments for the ends of the spring.

2. A screwless wire terminal for electric wires according to claim 1, wherein the ends of the stroke of the T-part are essentially opposite the ends of the stems of the U-part.

3. A screwless wire terminal for electric wires according to claim 1, wherein the width of the stems of the U-part and the T-part increase towards the arch of the U-part.

4. A screwless wire terminal for electric wires according to claim 1, wherein there is provided a push-button which is guided and held by the housing and which acts on the T-part of the spring clip.

* * * * *

UNITED STATES PATENT AND TRADEMARK OFFICE

CERTIFICATE OF CORRECTION

PATENT NO. : 4,217,021
DATED : August 13, 1980
INVENTOR(S) : Asger Illum

It is certified that error appears in the above—identified patent and that said Letters Patent is hereby corrected as shown below:

On the cover sheet, insert item (30) Foreign Application Priority Data:

-- Dec. 23, 1977 Denmark 5798/77 --.

Column 2, line 14, "constuction" should read construction --.

Signed and Sealed this

*Twenty-fifth* Day of *November 1980*

[SEAL]

*Attest:*

SIDNEY A. DIAMOND

*Attesting Officer* *Commissioner of Patents and Trademarks*